US010233046B2

(12) United States Patent
Maeda

(10) Patent No.: US 10,233,046 B2
(45) Date of Patent: Mar. 19, 2019

(54) SHEET DISCHARGING DEVICE

(71) Applicant: CANON KABUSHIKI KAISHA, Tokyo (JP)

(72) Inventor: Naoyuki Maeda, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/865,598

(22) Filed: Jan. 9, 2018

(65) Prior Publication Data

US 2018/0194585 A1 Jul. 12, 2018

(30) Foreign Application Priority Data

Jan. 11, 2017 (JP) ..... 2017-002375

(51) Int. Cl.
*B65H 29/22* (2006.01)
*B65H 31/10* (2006.01)
(Continued)

(52) U.S. Cl.
CPC ..... *B65H 29/22* (2013.01); *B65H 7/02* (2013.01); *B65H 29/14* (2013.01); *B65H 29/52* (2013.01); *B65H 29/70* (2013.01); *B65H 31/02* (2013.01); *B65H 31/10* (2013.01); *B65H 43/06* (2013.01); *B65H 43/08* (2013.01); *G03G 15/305* (2013.01); *G03G 15/36* (2013.01);
(Continued)

(58) Field of Classification Search
CPC ..... B65H 29/12; B65H 29/125; B65H 29/14; B65H 29/20; B65H 29/22; B65H 29/52; B65H 29/70; B65H 2301/5133; B65H 2301/5321; B65H 2404/61; B65H 2404/74; B65H 2404/741; B65H 2404/7412; B65H 2406/7414; B65H 2404/743; B65H 2404/561; B65H 2515/716; B65H 2533/612
See application file for complete search history.

(56) References Cited

U.S. PATENT DOCUMENTS 6,378,864 B1 * 4/2002 Iesaka ..... B65H 29/22 271/202
7,270,324 B2 9/2007 Ogata et al.
(Continued)

FOREIGN PATENT DOCUMENTS

JP 60002540 A * 1/1985 ..... B65H 29/22
JP S61-145758 A 7/1986
(Continued)

*Primary Examiner* — Prasad V Gokhale
(74) *Attorney, Agent, or Firm* — Venable LLP

(57) ABSTRACT

A sheet discharging device includes a stacking portion configured to stack a sheet; a discharging portion configured to feed the sheet so as to be discharged to the stacking portion, wherein the discharging portion includes a first roller configured to feed the sheet and a second roller provided so as to be contactable to a sheet surface opposite from another sheet surface to which the first roller is contactable to; and an electrically discharging member configured to electrically discharge the sheet in contact with the sheet fed by the discharging portion. As viewed in a widthwise direction perpendicular to a discharging direction of the sheet, the electrically discharging member is provided so as to extend through between rotational axes of the first and second rollers in the discharging direction of the sheet.

12 Claims, 9 Drawing Sheets

(51) Int. Cl.

| | |
|---|---|
| ***G03G 15/00*** | (2006.01) |
| ***B65H 31/02*** | (2006.01) |
| ***G03G 15/30*** | (2006.01) |
| ***B65H 29/14*** | (2006.01) |
| ***G03G 15/36*** | (2006.01) |
| ***B65H 7/02*** | (2006.01) |
| ***B65H 29/52*** | (2006.01) |
| ***B65H 29/70*** | (2006.01) |
| ***B65H 43/06*** | (2006.01) |
| ***B65H 43/08*** | (2006.01) |

(52) U.S. Cl.

CPC . *G03G 15/6538* (2013.01); *B65H 2301/4212* (2013.01); *B65H 2301/5122* (2013.01); *B65H 2301/5133* (2013.01); *B65H 2301/5321* (2013.01); *B65H 2404/144* (2013.01); *B65H 2404/561* (2013.01); *B65H 2404/63* (2013.01); *B65H 2404/7414* (2013.01); *B65H 2405/11151* (2013.01); *B65H 2515/716* (2013.01); *B65H 2553/612* (2013.01); *B65H 2801/06* (2013.01)

(56) References Cited

U.S. PATENT DOCUMENTS

| | | | | |
|---|---|---|---|---|
| 8,787,815 | B2 | 7/2014 | Maeda | |
| 9,417,586 | B2 * | 8/2016 | Izumichi | G03G 15/6529 |
| 2005/0035535 | A1 | 2/2005 | Ogata et al. | |
| 2013/0063856 | A1 * | 3/2013 | Koo | G07D 11/0018 361/212 |
| 2015/0054215 | A1 * | 2/2015 | Sato | B65H 29/52 271/208 |
| 2015/0153699 | A1 * | 6/2015 | Michibata | B65H 29/22 271/182 |
| 2016/0083215 | A1 * | 3/2016 | Furuta | B65H 37/00 271/208 |
| 2016/0161875 | A1 * | 6/2016 | Yamamoto | G03G 15/0216 399/405 |

FOREIGN PATENT DOCUMENTS

| | | | |
|---|---|---|---|
| JP | H10-157905 | A | 6/1998 |
| JP | 2004-284788 | A | 10/2004 |
| JP | 2005-035691 | A | 2/2005 |

* cited by examiner

SHEET DISCHARGING DEVICE

FIELD OF THE INVENTION AND RELATED ART

The present invention relates to a sheet discharging device mounted in an image forming apparatus such as an electrophotographic copying machine or an electrophotographic printer or in a post-processing device, of a sheet, connected with the image forming apparatus.

In the electrophotographic copying machine or printer or in the sheet post-processing device connected with the copying machine or the printer, the sheet discharging device is mounted. This sheet discharging device includes a tray for stacking a sheet, a roller for discharging the sheet onto the tray, and an electrically discharging brush for electrically discharging the sheet discharged onto the tray by the roller.

Japanese Laid-Open Patent Application (JP-A) Hei 10-157905 discloses a technique such that static electricity of the sheet is removed by an electrically discharging brush provided on a downstream side of a sheet discharging direction of a roller. JP-A 2005-35691 discloses a technique such that a stacking height of sheet(s) stacked on a tray is detected by a sensor provided on a downstream side of a sheet discharging direction of a roller.

In the sheet discharging device, in order to decrease a height of the image forming apparatus such as the copying machine or the printer or of the sheet post processing device, a depth of the tray is required to be shallow with respect to an apparatus main assembly. Particularly, in the copying machine or the printer, the shallow tray is essential to decrease a tray interval in a multi tray (sheet) discharging device in which a plurality of trays are provided at an upper portion of an image forming portion for forming an image on the sheet.

As disclosed in JP-A 2005-35691, the sheet sensor has a sheet supporting (holding) function and, in order to meet the shallow tray, is provided so that a rotation supporting point of the sheet sensor is positioned downstream of a nip of rollers with respect to the sheet discharging direction. As disclosed in JP-A Hei 10-157905, the electrically discharging brush is provided so as to perpendicularly contact the sheet in a position downstream of a nip of rollers with respect to the sheet discharging direction.

In the above-described sheet discharging device, when the sheet sensor rotates in a direction of being spaced from the tray by the sheet, the electrically discharging brush is raised by the sheet sensor. For that reason, with respect to a direction perpendicular to the sheet discharging direction, the electrically discharging brush cannot be contacted to the sheet uniformly, so that there is a problem such that an electrically discharging effect decreases.

SUMMARY OF THE INVENTION

According to an aspect of the present invention, there is provided a sheet discharging device comprising: a stacking portion configured to stack a sheet; a discharging portion configured to feed the sheet so as to be discharged to the stacking portion, wherein the discharging portion includes a first roller configured to feed the sheet and a second roller provided so as to be contactable to a sheet surface opposite from another sheet surface to which the first roller is contactable; and an electrically discharging member configured to electrically discharge the sheet in contact with the sheet fed by the discharging portion, wherein as viewed in a widthwise direction perpendicular to a discharging direction of the sheet, the electrically discharging member is provided so as to extend through between rotational axes of the first and second rollers in the discharging direction of the sheet.

Further features of the present invention will become apparent from the following description of exemplary embodiments with reference to the attached drawings.

DESCRIPTION OF EMBODIMENTS

Embodiments of the present invention will be described with reference to the drawings. Although these embodiments are preferred embodiments of the present invention, the present invention is not limited to the following embodiments, but can be replaced with other various constitutions within a scope of a concept of the present invention.

[Embodiment 1]

<Image Forming Apparatus 10>

Figure 7:
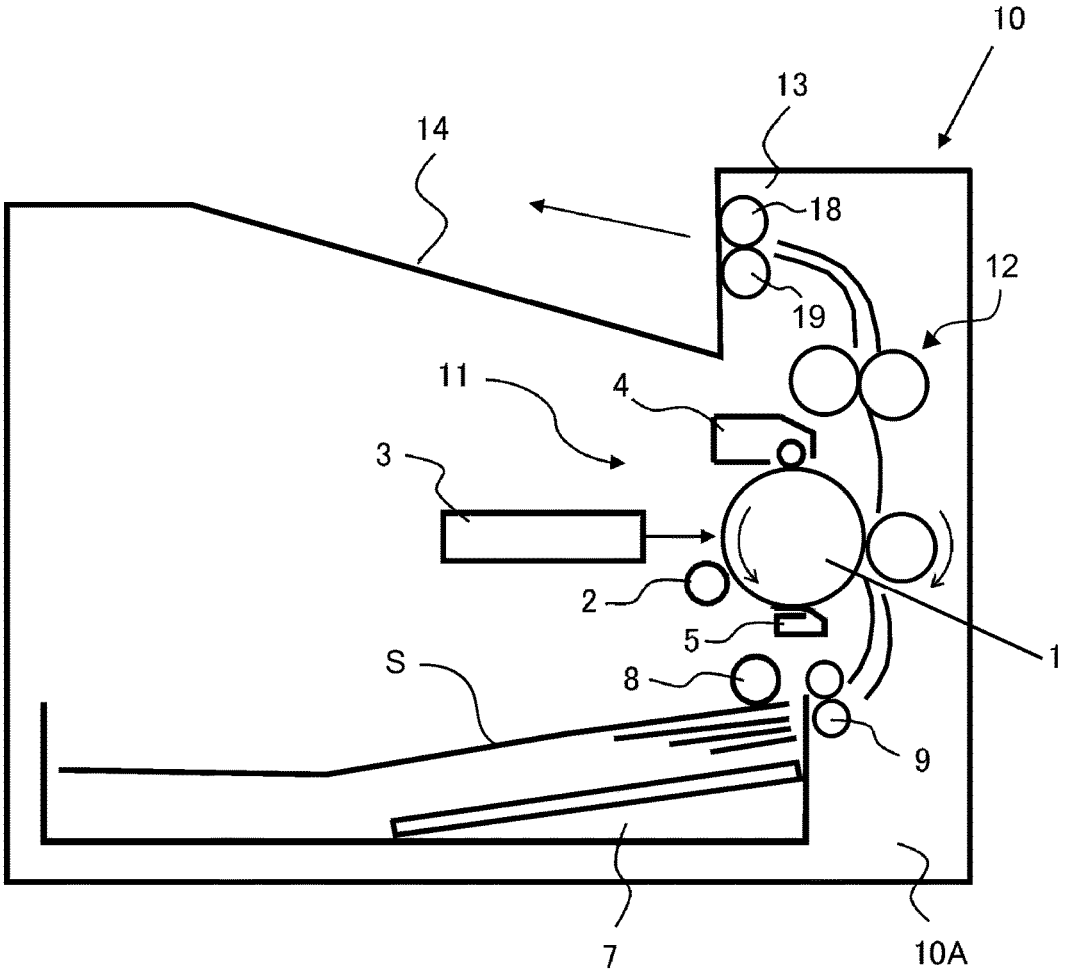
FIG. 7 is a sectional view showing a general structure of an example of an image forming apparatus.

With reference to FIG. 7, an image forming apparatus 10 in which a sheet discharging device according to this embodiment will be described. FIG. 7 is a sectional view showing a general structure of an example of the image forming apparatus (a monochromatic printer in this embodiment) 10 using an electrophotographic recording technique.

In the image forming apparatus 10, an image forming portion 11 for forming an image on a sheet S such as recording paper includes a photosensitive drum 1 as an image bearing member, a charging member 2, a laser scanner 3, a developing device 4, a cleaner 5 for cleaning an outer peripheral surface of the photosensitive drum 1, and a transfer member 6. An operation of the image forming portion 11 is well known, and therefore, will be omitted from detailed description.

The sheet S such as recording paper accommodated in a cassette 7 in an apparatus main assembly 10A is fed one by one by rotation of a roller 8, and therefore, is conveyed to a transfer portion, formed by the photosensitive drum 1 and the transfer member 6, by rotation of a roller 9. The sheet S on which a toner image is transferred by the transfer portion is sent to fixing device 12, and the toner image is heat-fixed on the sheet S by the fixing device. The sheet S coming out of the fixing device 12 is discharged onto a tray 14 by rotation of rollers 18 and 19 of a sheet discharging device 13.

<Sheet Discharging Device 13>

Figure 1:
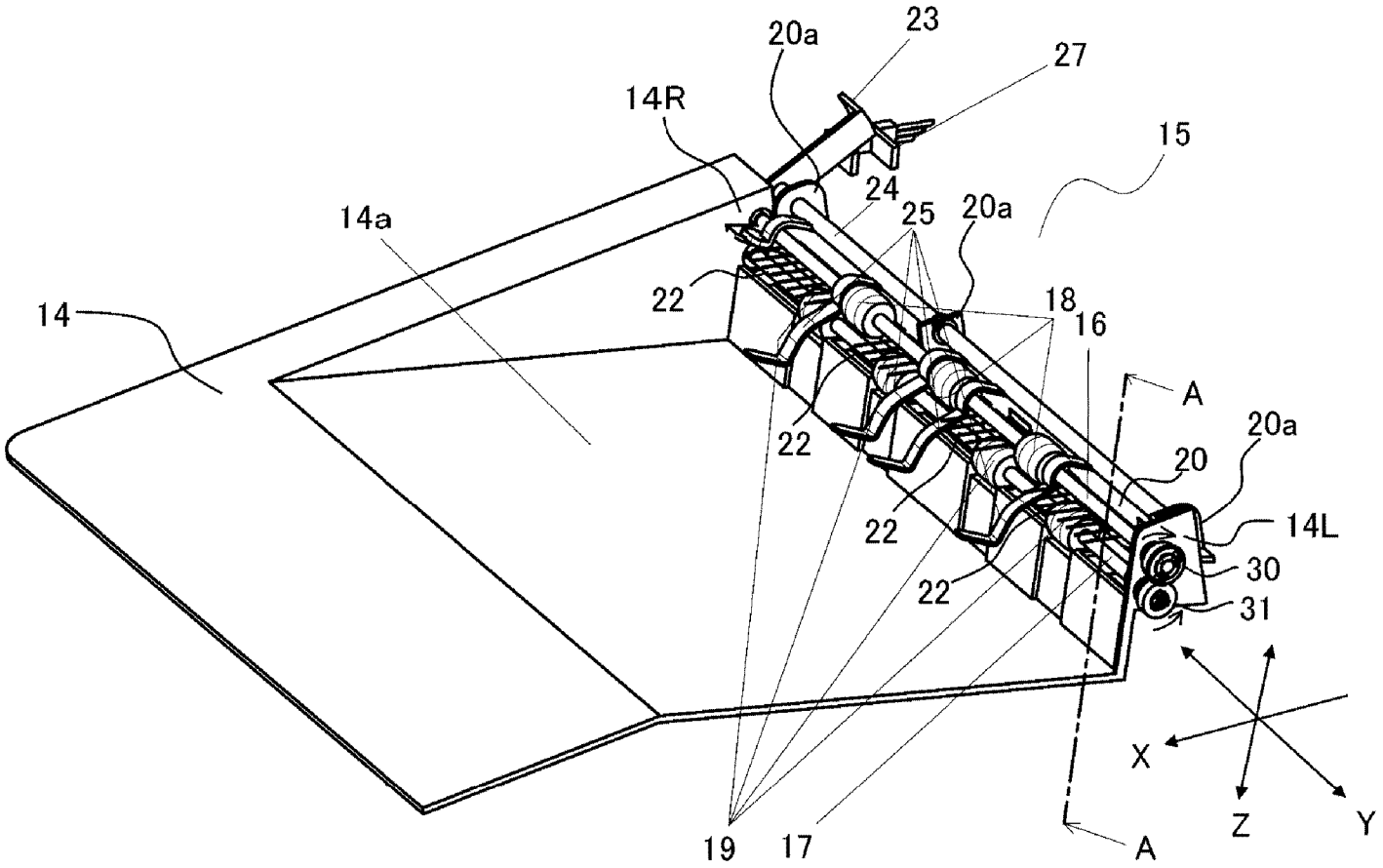
FIG. 1 is a perspective view showing a general structure of a sheet discharging device according to Embodiment 1.
Figure 2:
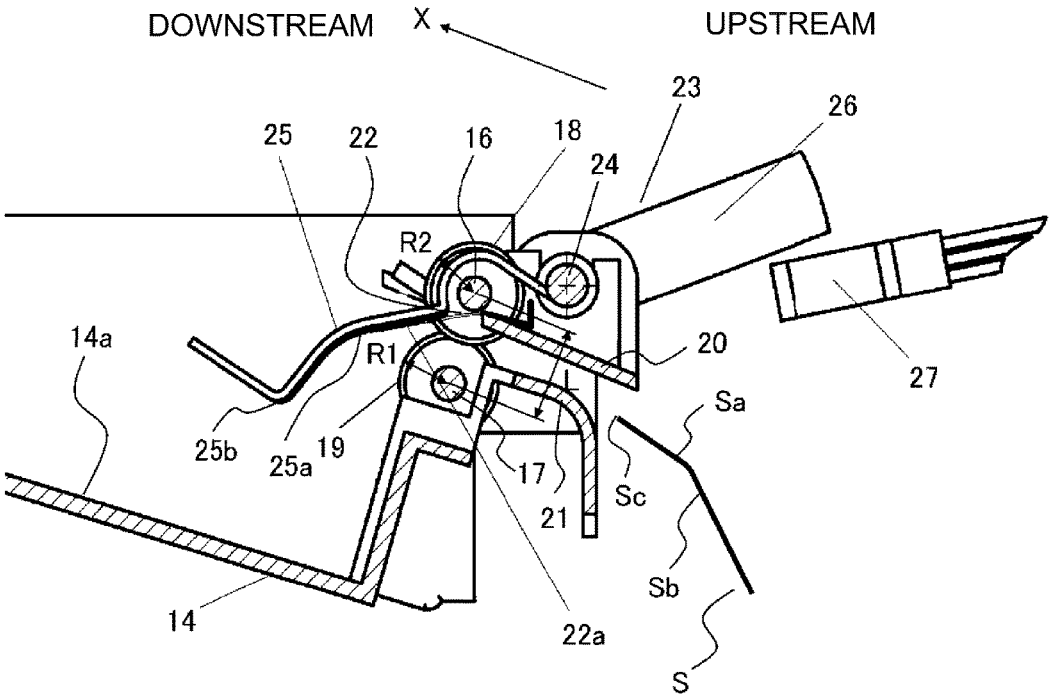
FIG. 2 is a sectional view of the sheet discharging device taken along an A-A line shown in FIG. 1.

With reference to FIGS. 1 and 2, the sheet discharging device 13 will be described. FIG. 1 is a perspective view showing a general structure of the sheet discharging device 13 according to this embodiment. FIG. 2 is a sectional view of the sheet discharging device 13 taken along an A-A line shown in FIG. 1.

The sheet discharging device 13 in this embodiment includes the tray as a stacking portion for stacking the sheet S and a discharging portion 15 as a discharging means for discharging the sheet S onto the tray. The sheet discharging device 13 further includes an electrically discharging brush 22 as an electrically discharging member for electrically discharging the sheet S discharged onto the tray 14 by the discharging portion 15, and a sheet sensor 23 as a detecting member for detecting the sheet S discharged onto the tray 14 by the discharging portion 15.

The discharging portion 15 includes a two rotatable shafts 16 and 17 provided along a direction (hereinafter referred to as a longitudinal direction) Y perpendicular to a sheet discharging direction X and rollers 18 (first roller) and 19 (second roller) which are fixed on these shafts 16 and 17, respectively, for feeding the sheet S while nipping the sheet S. The direction perpendicular to the sheet discharging direction X is also a widthwise direction of the sheet S. With respect to the longitudinal direction Y perpendicular to the sheet discharging direction X, both end portions of the two shafts 16 and 17 are rotatably supported by feed guides 14R and 14L provided on both sides of a sheet stacking surface 14*a* of the tray 14. With respect to the longitudinal direction Y perpendicular to the sheet discharging direction X, the feed guides 14R and 14L guide both ends of the sheet S conveyed by the rollers 18 and 19.

The shaft 16 is disposed on a sheet surface Sa side of the sheet S conveyed by the rollers 18 and 19, and the shaft 17 is disposed on a sheet surface Sb side opposite from the sheet surface Sa side (FIG. 2). That is, the roller 19 is provided so as to be contactable to the surface, of the sheet S, opposite from the surface to which the roller 18 is contactable. To the shaft 16, four rollers 18 are fixed, and to the shaft 17, four rollers 19 are fixed. These rollers 18 and 19 are disposed alternately with predetermined intervals so as not to be in contact with each other with respect to the longitudinal direction Y perpendicular to the sheet discharging direction X. That is, the rollers 18 are provided at different positions from the rollers 19 with respect to the longitudinal direction Y.

Here, with respect to a direction (hereinafter referred to as a perpendicular direction) Z perpendicular to the surface (plane) of the sheet S, a distance between rotation centers of the two shafts 16 and 17 is L, and radii of the rollers 18 and 19 are R1 and R2, respectively, a relationship of: $L<R1+R2$ is satisfied. That is, as viewed in the longitudinal direction X, the roller 18 overlaps with the roller 19 with respect to a radial direction of the roller 18.

That is, the rollers 18 and 19 disposed alternately on the shafts 16 and 17 overlap with each other with respect to the direction perpendicular to the sheet discharging direction X and perpendicular to the longitudinal direction Y so that outer diameter portions of the rollers 18 and 19 enter in the perpendicular direction perpendicular to the sheet discharging direction X. As a result, when the sheet S is conveyed by the rollers 18 and 19, the outer diameter portions of the rollers 18 and 19 are contacted to the sheet S so that the sheet S waves with respect to the longitudinal direction Y perpendicular to the sheet discharging direction X.

With respect to the longitudinal direction Y perpendicular to the sheet discharging direction X, to the feed guides 14L and 14R, a first guide 20 and a second guide 21 are provided (FIG. 2). With respect to the perpendicular direction Z perpendicular to the sheet S, the first guide 20 is provided on the roller 18 side, and the second guide 21 is provided on the roller 19 side. The guides 20 and 21 guide the leading end Sc, with respect to the discharging direction of the sheet S coming out of the fixing device 12, to between the rollers 18 and 19.

The guide 20 is provided with the electrically discharging brush 22. The electrically discharging brush 22 is provided between the feed guide 14L and the shaft 17 which are adjacent to each other, between adjacent shaft portions 17 and between the shaft 17 and the feed guide 14R which are adjacent to each other, with respect to the longitudinal direction Y perpendicular to the sheet discharging direction X. That is, portions of the electrically discharging brush 22 are disposed alternately with the rollers 18 with respect to the longitudinal direction Y perpendicular to the sheet discharging direction X (FIG. 1). Further, the electrically discharging brush 22 is disposed so as to extend from an upstream side toward a downstream side with respect to the sheet discharging direction X between the shafts 16 and 17. That is, as viewed in a widthwise direction perpendicular to the sheet discharging direction X, the electrically discharging brush 22 is provided so as to extend through between a rotational axis of the roller 18 and a rotational axis of the roller 19 in the sheet discharging direction X.

The sheet sensor 23 includes a rotatable shaft 24 provided along the longitudinal direction Y perpendicular to the sheet discharging direction X, four contact portions 25 which are fixed on the shaft 24 and which are contactable to the leading end Sc of the sheet S, and a flag 26 which is fixed on the shaft 24 and which causes a photo-sensor 27 to permit light transmission or block light. The photo-sensor 27 detects rotation of the flag 26.

The shaft 24 is provided upstream of the shafts 16 and 17 of the discharging portion 15 with respect to the sheet discharging direction X. With respect to the longitudinal direction Y perpendicular to the sheet discharging direction X, the shaft 24 is rotatably supported at a central portion and both end portions thereof by supporting portions 20*a* provided at a central portion and both end portions of the guide 20.

The contact portions 25 are provided between the feed guide 14L and the shaft 17 which are adjacent to each other, between adjacent shaft portions 17 and between the shaft 17 and the feed guide 14R which are adjacent to each other. The contact portions 25 are fixed to the shaft 24 on an upstream side with respect to the sheet discharging direction X. The contact portions 25*a* are provided with tapered portions 25*a* which are positioned on a downstream side with respect to the sheet discharging direction X and which are inclined in a direction crossing the sheet discharging direction X, and are further provided with V-shaped sheet supporting (holding) portions 25*b* positioned downstream of the tapered portions 25*a* with respect to the sheet discharging direction X.

The flag 26 is fixed to an end portion of the shaft 24 on the shaft 14R side with respect to the longitudinal direction Y perpendicular to the sheet discharging direction X.

A sheet discharging process operation of the sheet discharging device 13 will be described while making reference to FIGS. 1 and 3A to 3E. FIGS. 3A to 3E are sectional views for illustrating the sheet discharging process operation at positions where the tapered portions 25*a* of the contact portions 25 of the sheet sensor 23 and free end portions 22*a* of the electrically discharging brushes 22 are in contact with each other. In positions other than the positions shown in FIGS. 3A to 3E, the electrically discharging brushes 22 electrically discharge the sheet S in a state in which the free end portions 22*a* of the electrically discharging brushes 22 contact the sheet S.

Figure 3A:
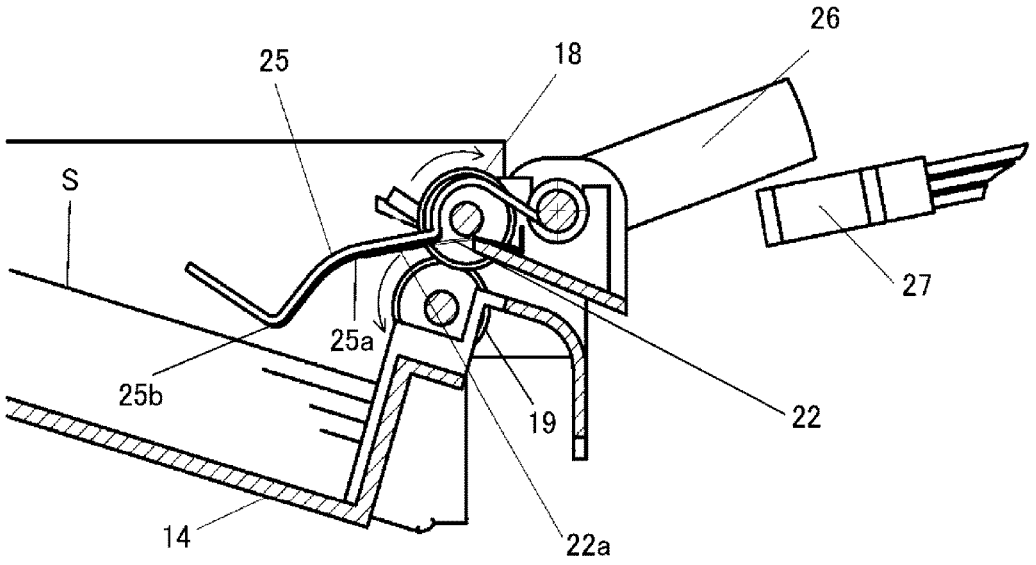
FIGS. 3A to 3E are sectional views for illustrating an operation of the sheet discharging device in Embodiment 1.
Figure 3B:
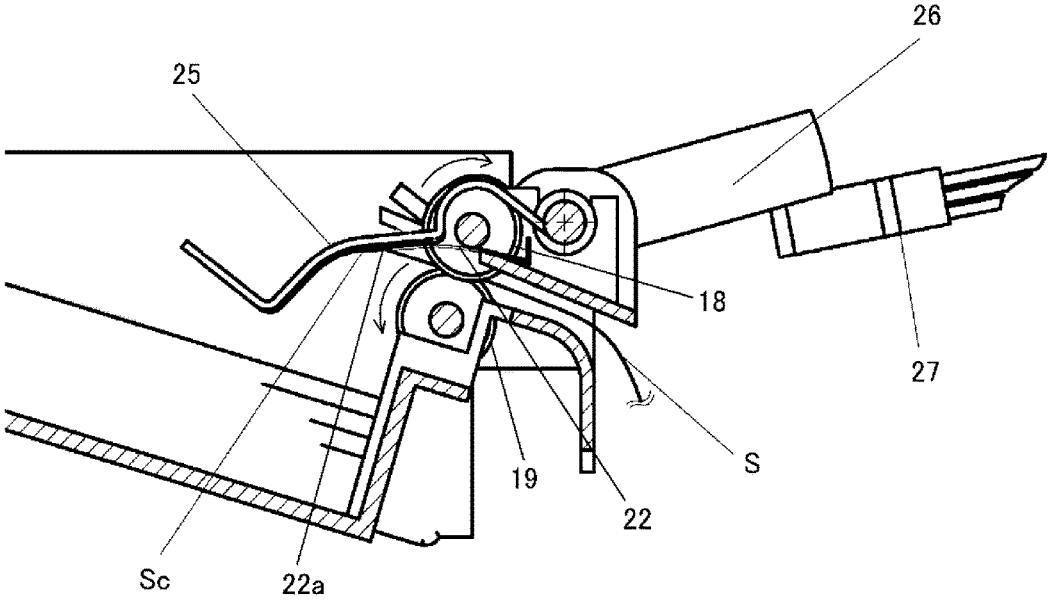

FIG. 3A is the sectional view showing a stand-by state of the sheet discharging device 13. FIG. 3B is the sectional view showing a state in which the leading end Sc of the sheet S contacts the electrically discharging brushes 22. FIG. 3A is the sectional view showing a state in which the leading end Sc of the sheet S contacts the sheet sensor 23. FIG. 3D is the sectional view showing a state in which the sheet S is being discharged onto the tray 14 by the rollers 18 and 19 of the discharging portion 15. FIG. 3E is the sectional view showing a state in which the sheet sensor 23 contacts an uppermost sheet S stacked on the tray 14.

As shown in FIG. 1, gears 30 and 31 are provided at one end portion of the shafts 16 and 17 on the feed guide 14L side. These two gears 30 and 31 engage with each other. When the gear 30 is rotated in an arrow direction by a motor (not shown), the gear 31 is rotated by rotation of the gear 30.

As shown in FIG. 3A, in the stand-by state, the free end portions 22*a* of the electrically discharging brushes 22 contact the tapered portions 25*a* of the contact portions 25. The sheet supporting portions 25*b* of the contact portion 25 are in non-contact with the sheet S stacked on the sheet stacking surface 14*a* of the tray 14. The flag 26 causes the photo-sensor 26 to be in a light-transmission state.

As shown in FIG. 3B, when the sheet S coming out of the fixing device 12 is conveyed in the sheet discharging direction X while being nipped by the rollers 18 and 19, the leading end Sc of the sheet S slides on the free end portions 22*a* of the electrically discharging brushes 22 while contacting the free end portions 22*a*. Therefore, with respect to the sheet discharging direction X, the free end portions 22*a* of the electrically discharging brushes 22 are disposed upstream of a position where the leading end Sc of the sheet S contacts the contact portions 25.

Figure 3C:
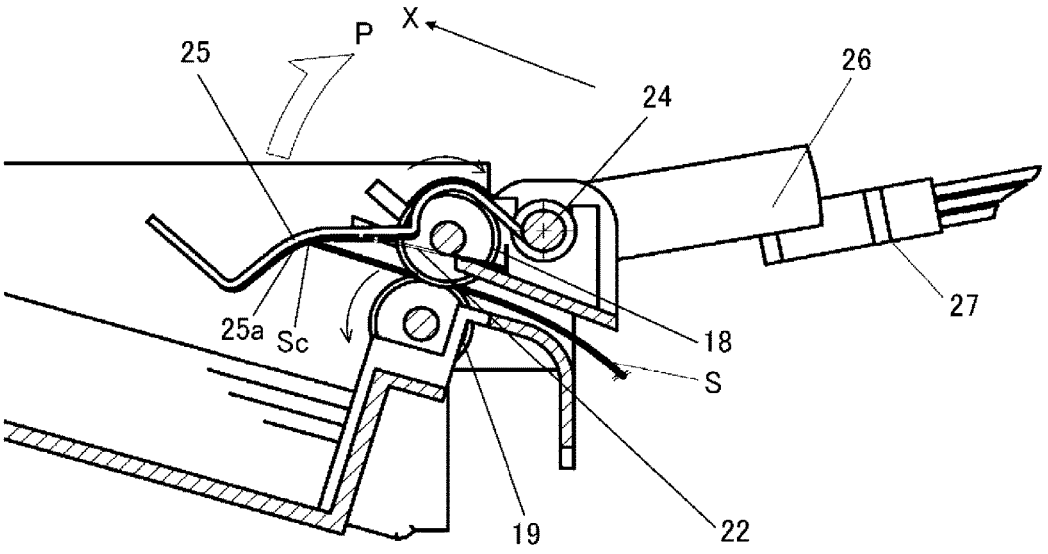
Figure 3D:
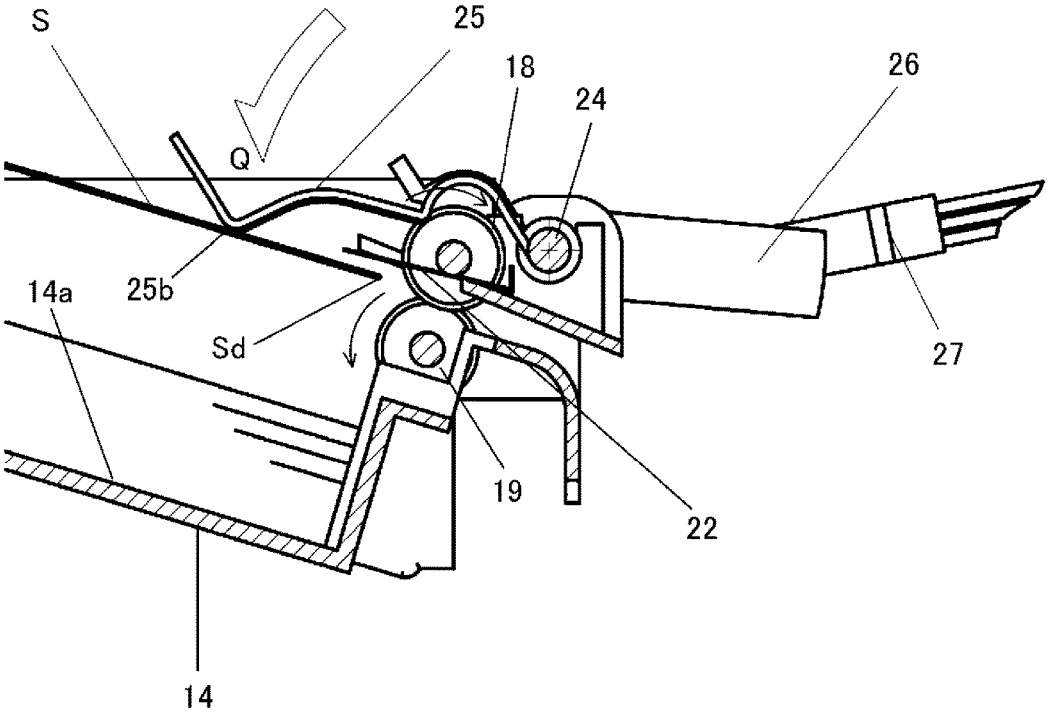
Figure 3E:
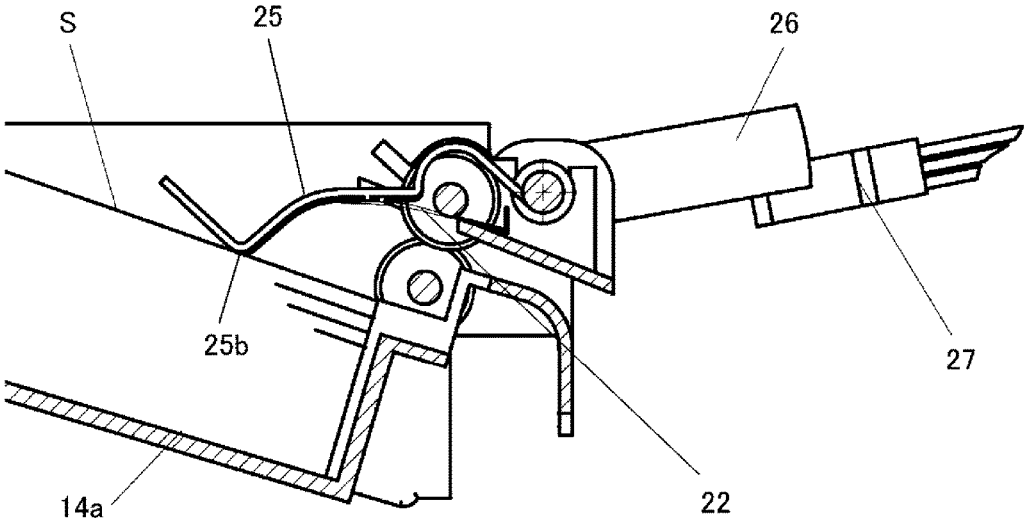

As shown in FIG. 3C, when the sheet S is conveyed by the rollers 18 and 19, the tapered surfaces 25*a* of the contact portions 25 are pushed in the sheet discharging direction X by the leading end Sc of the sheet S. Then, the contact portions 25 are rotated together with the shaft 24 in an arrow P direction in a predetermined amount, and with the rotation of the shaft 24, the feed guide 26 is rotated in the same direction and causes the photo-sensor 27 to block the light. At that time, the tapered surfaces 25*a* and the free end portions 22*a* of the electrically discharging brushes 22 are spaced from each other, but the sheet S is conveyed while contacting the free end portions 22*a* of the electrically discharging brushes 22 at a sheet surface Sa thereof. The flag 26 causes the photo-sensor 27 to block the light, so that the photo-sensor 27 detects the sheet S discharged onto the tray 14.

As shown in FIG. 3D, when a trailing end Sd of the sheet S is discharged from between the rollers 18 and 19 with respect to the sheet discharging direction X, the sheet supporting portions 25*b* of the contact portions 25 contact the sheet surface Sa of the sheet S. The contact portions 25 rotate together with the shaft 24 in an arrow Q direction by a self-weight of the contact portions 25 correspondingly to a drop of the sheet S due to a self-weight of the sheet S in a state in which the sheet supporting portions 25*b* of the contact portions 25 are contacted to the sheet surface Sa, so that the contact portions 25 start a drop thereof toward the sheet stacking surface 14*a* side of the tray 14.

In the case where the sheet supporting portions 25*b* of the contact portions 25 do not contact the uppermost sheet stacked on the sheet stacking surface 14*a*, the contact portions 25 rotate together with the shaft 24 in the arrow Q direction in a predetermined amount and is restored to the position thereof in the stand-by state. With the rotation of the shaft 24, the flag 26 rotates in the same discharge and is restored to the position thereof in the stand-by state. At that time, the free end portions 22*a* of the electrically discharging brushes 22 contact the tapered surfaces 25*a*.

As shown in FIG. 3E, when the sheet supporting portions 25*b* of the contact portions 25 contact the uppermost sheet S stacked on the sheet stacking surface 14*a*, the contact portions 25 cannot rotate the shaft 24 to a position where the contact portions 25 can be restored to the stand-by state thereof. As a result, the flag 26 causes the photo-sensor 27 to block the light and thus detects a stacking upper limit of the sheet S stacked on the tray 14.

A controller (not shown) provided in the apparatus main assembly 10A causes the image forming apparatus 10 to stop an operation when the controller detects that the photo-sensor 27 is in the light-blocking state. In the case where the image forming apparatus 10 includes a display portion, the display portion notifies a user that a stacking amount of the sheet S reached the stacking upper limit. The display portion also notifies instruction devices, to which a print instruction is outputted, that printing is stopped due to arrival of the stacking amount at the stacking upper limit.

The sheet discharging device 13 in this embodiment can cause the electrically discharging brushes 22 to contact the sheet S during conveyance of the sheet S since the electrically discharging brushes 22 are disposed so as to extend from the upstream side toward the downstream side, with respect to the sheet discharging direction X, through between the two shafts 16 and 17 of the discharging portion 15. Therefore, the sheet discharging device 13 achieves an effect such that an electrically discharging effect of the sheet S by the electrically discharging brushes 22 can be improved. Further, the electrically discharging brushes 22 can be contacted to the sheet S without being influenced by a rotational operation of the contact portions 25 of the sheet sensor 23, and therefore, a similar effect is achieved. Further, also in a region in which the flag 26 of the sheet sensor 23 is absent, the electrically discharging brushes 22 are in the contact state with the sheet S, and therefore, a similar effect is achieved.

[Embodiment 2]

Another embodiment of the sheet discharging device 13 will be described. In this embodiment, only a constitution different from the constitution of Embodiment 1 will be described.

Figure 4:
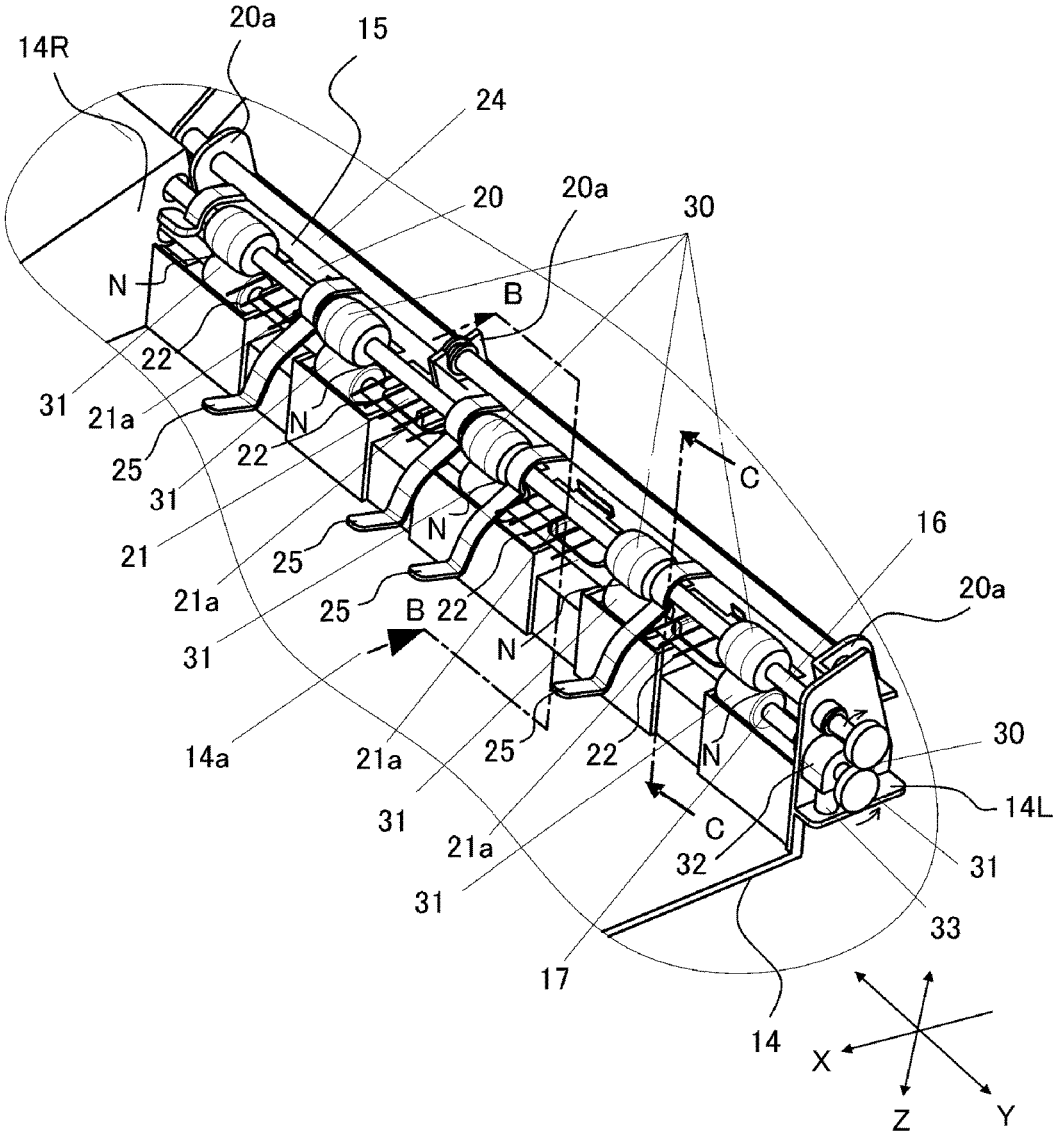
FIG. 4 is a perspective view showing a general structure of a sheet discharging device according to Embodiment 2.
Figure 5:
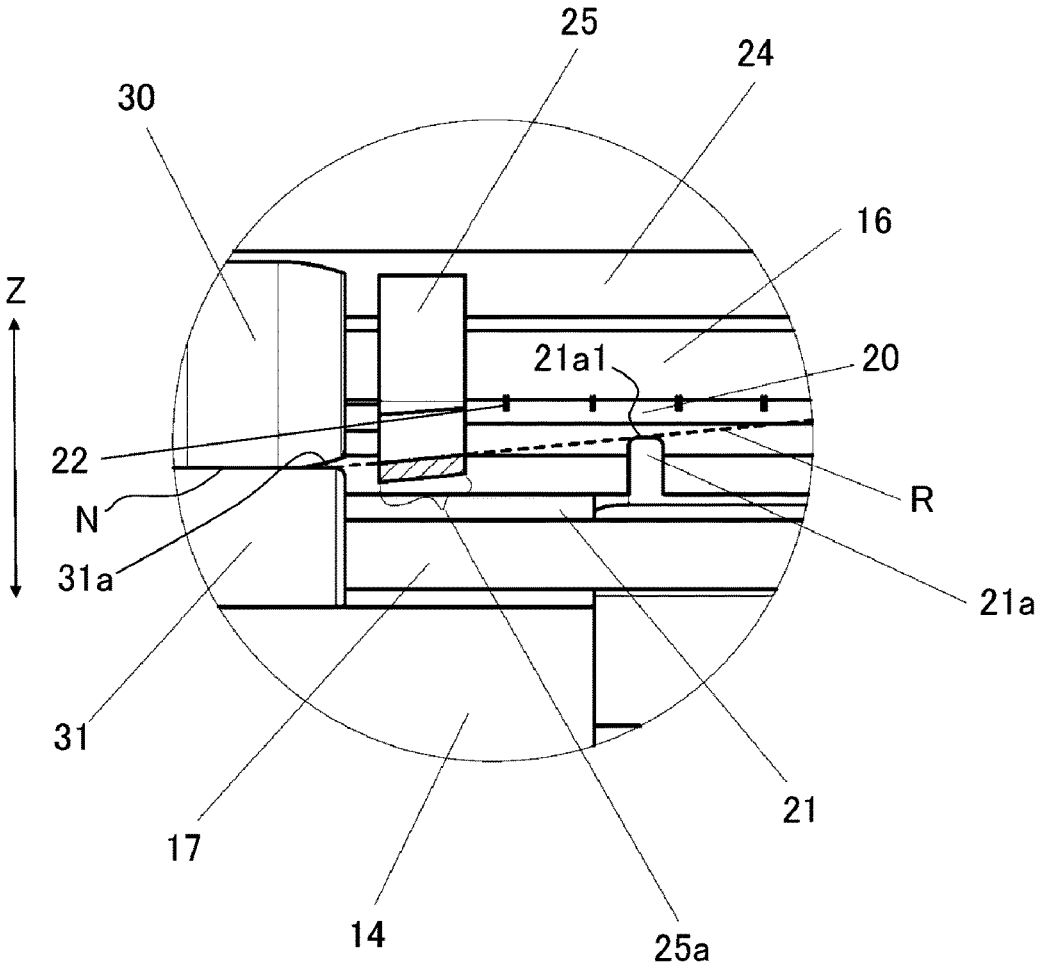
FIG. 5 is a sectional view of the sheet discharging device taken along a B-B line shown in FIG. 4.
Figure 6:
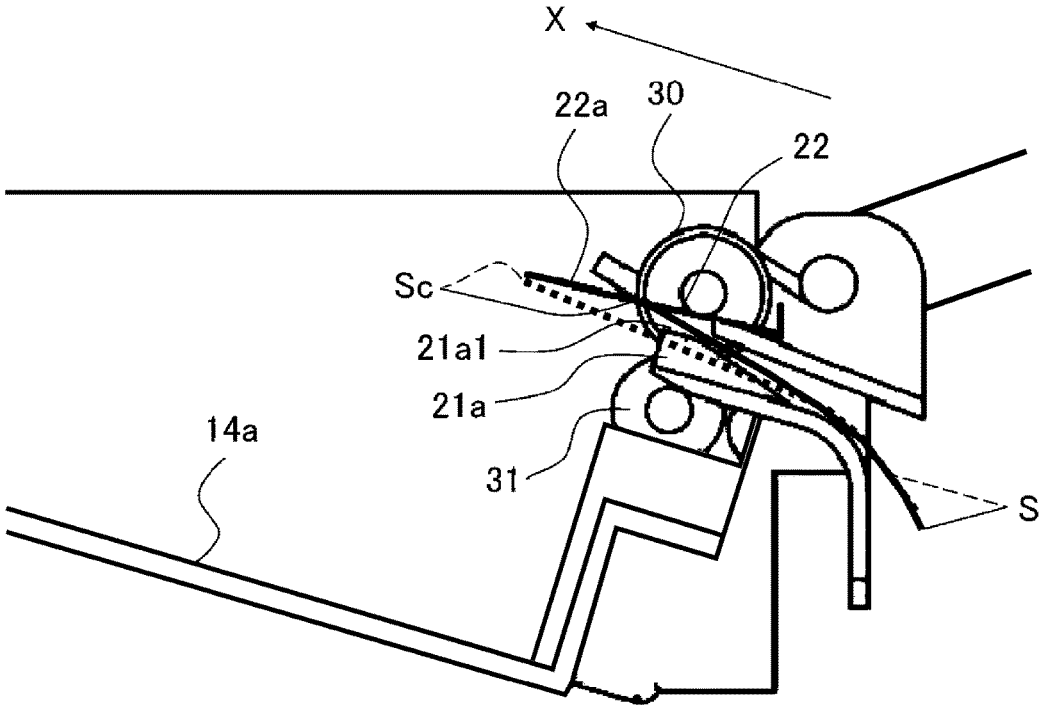
FIG. 6 is a sectional view of the sheet discharging device taken along a C-C line shown in FIG. 4.

FIG. 4 is a perspective view showing a general structure of a sheet discharging device 13 according to this embodiment. FIG. 5 is a sectional view of the sheet discharging device 13 taken along a B-B line shown in FIG. 4. FIG. 6 is a sectional view of the sheet discharging device 13 taken along a C-C line shown in FIG. 4.

The sheet discharging device 13 in this embodiment is different from Embodiment 1 in a constitution of the discharging portion 15 and in that a guide 21 is provided with ribs 21*a* as contacting means.

As shown in FIG. 4, with respect to the longitudinal direction Y perpendicular to the sheet discharging direction X, one shaft 16 of the discharging portion 16 is provided with five rollers 30 fixed on the shaft 16, and the other shaft 17 of the discharging portion 15 is provided with five rollers 31 fixed on the shaft 17 at positions opposing the rollers 30.

At both end portions of the shaft 17, spring bearing members 32 are engaged with the shaft 17. Further, at each of the end portions of the shaft 17, a pressing (urging) spring 33 is provided between the spring bearing member 32 and the feed guide 14L(14R), so that the pressing springs 33 push up the spring bearing member 32 toward the sheet S with respect to the perpendicular direction Z. As a result, an outer peripheral surface of the roller 31 is pressed against an outer peripheral surface of the roller 30, so that a nip N is formed by the surfaces of the rollers 31 and 30.

The guide 21 is provided with four ribs 21*a*. Here, the guide 21 is a member provided, on the roller 31 side, for guiding the sheet S to the nip N with respect to the sheet discharging direction X. Each of the ribs 21*a* is disposed between adjacent rollers 31 with respect to the longitudinal direction Y perpendicular to the sheet discharging direction X (FIG. 4).

As shown in FIG. 5, each of the ribs 21*a* extends over the outer peripheral surface 31*a* of the roller 31 and projects toward the roller 30 side with respect to the perpendicular direction Z perpendicular to the sheet discharging direction X. With respect to the longitudinal direction Y perpendicular to the sheet discharging direction X, a rectilinear line R connecting a surface 21*a*1 of the rib 21*a* on the roller 30 side with the outer peripheral surface 31*a* of the roller 31, and a tapered surface 25*a*, of each of the contact portions 25, to which the leading end Sc of the sheet S is contactable are parallel to each other. As a result, when the sheet S is conveyed by the rollers 30 and 31, the ribs 21*a* contact the sheet S so that the sheet S is waved by the surfaces 21*a*1 of the ribs 21*a*.

Further, when the sheet S is conveyed by the rollers 30 and 31, as shown in FIG. 6, the ribs 21*a* guides the leading end Sc of the sheet S toward the electrically discharging brushes 22 by the surfaces 21*a*1 of the ribs 21*a* on the roller 30 side. For that reason, with respect to the sheet discharging direction X, the leading end Sc of the sheet S, in this embodiment, indicated by a solid line can be contacted to a position in front of the free end portions 22*a* of the electrically discharging brushes 22. A broken line shows a state in which the leading end Sc of the sheet S in Embodiment 1 contacts the free end portions 22*a* of the electrically discharging brushes 22.

As shown in FIG. 4, in the sheet discharging device 13 in this embodiment, when the gear 30 is rotated in an arrow direction by the motor, the gear 31 is rotated by rotation of the gear 30. The sheet S coming out of the fixing device 12 is guided to the nip N by guides 20 and 21.

When the sheet S is conveyed in the sheet discharging direction X while being nipped by the rollers 30 and 31, the leading end Sc of the sheet S slides on the free end portions 22*a* of the electrically discharging brushes 22 while contacting the free end portions 22*a*. Therefore, with respect to the sheet discharging direction X, the free end portions 22*a* of the electrically discharging brushes 22 are disposed upstream of a position where the leading end Sc of the sheet S contacts the contact portions 25.

Also in the sheet discharging device 13 in this embodiment, the electrically discharging brushes 22 are disposed so as to extend from the upstream side toward the downstream side, with respect to the sheet discharging direction X, through between the two shafts 16 and 17 of the discharging portion 15, and therefore, the sheet discharging device 13 achieves an effect similar to that in Embodiment 1. Further, the electrically discharging brushes 22 can be contacted to the sheet S without being influenced by a rotational operation of the contact portions 25 of the sheet sensor 23, and therefore, the effect similar to that in Embodiment 1 is achieved. Further, also in a region in which the flag 26 of the sheet sensor 23 is absent, the electrically discharging brushes 22 are in the contact state with the sheet S, and therefore, the effect similar to that in Embodiment 1 is achieved.

The sheet discharging device 13 in this embodiment is applicable to not only the image forming apparatus 10 but also a sheet post-process device connected with the image forming apparatus 10.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-002375 filed on Jan. 11, 2017, which is hereby incorporated by reference herein in its entirety.

What is claimed is:

1. A sheet discharging device comprising:

a stacking portion configured to stack a sheet;

a discharging portion configured to feed the sheet so as to be discharged to said stacking portion, wherein said discharging portion includes a first roller configured to feed the sheet and a second roller provided so as to be contactable to a sheet surface opposite from another sheet surface to which said first roller is contactable;

a guiding portion configured to guide the sheet toward said discharging portion, said guiding portion being provided upstream of said discharging portion with respect to a discharging direction of the sheet; and an electrically discharging member configured to electrically discharge the sheet in contact with the sheet fed by said discharging portion, wherein an upstream end of said electrically discharging member with respect to the discharging direction is fixed to said guiding portion, wherein a downstream end of said electrically discharging member with respect to the discharging direction is positioned on a side downstream of said discharging portion as a free end, and wherein as viewed in a widthwise direction of the sheet perpendicular to a discharging direction of the sheet, said electrically discharging member is provided so as to extend between rotational axes of said first and second rollers in the discharging direction of the sheet.

2. A sheet discharging device according to claim 1, wherein with respect to a widthwise direction of the sheet, said first roller and said second roller are provided in different positions, and wherein as viewed in the widthwise direction, said first roller and said second roller overlap with each other with respect to a radial direction of said first roller.

3. A sheet discharging device according to claim 1, further comprising a detecting portion configured to detect the sheet discharged by said discharging portion, wherein said detecting portion includes a flag movable in contact with the sheet discharged by said discharging portion toward a side downstream of said discharging portion with respect to the discharging direction of the sheet and includes a sensor configured to detect movement of said flag, and wherein with respect to the discharging direction of the sheet, a downstream end of said electrically discharging member is positioned on a side upstream of a portion where a leading end of the sheet contacts said flag.

4. A sheet discharging device according to claim 3, wherein said detecting portion detects that a number of sheets stacked on said stacking portion is an upper limit.

5. A sheet discharging device according to claim 1, wherein said electrically discharging member includes an electrically discharging brush.

6. An image forming apparatus comprising a sheet discharging device according to claim 1.

7. A sheet discharging device comprising:

a stacking portion configured to stack a sheet;

a discharging portion configured to discharge the sheet to said stacking portion; and an electrically discharging member configured to electrically discharge the sheet discharged to said stacking portion by said discharging portion, wherein said discharging portion includes (a) two rotatable shafts provided along a direction perpendicular to a sheet discharging direction and (b) rollers fixed on said two shafts for feeding the sheet, wherein said rollers are disposed alternately on said two shafts and satisfy a relationship of $L<R1+R2$, where a distance between rotation centers of said two shafts is L, and radii of said rollers fixed on said two shafts are R1 and R2, respectively, wherein said electrically discharging member is disposed between said two shafts so as to extend from an upstream side toward a downstream side with respect to the sheet discharging direction, and wherein a downstream end of said electrically discharging member is a free end.

8. A sheet discharging device according to claim 7, wherein said rollers disposed alternately on said two shafts overlap with each other with respect to a direction perpendicular to the sheet discharging direction so that outer diameter portions of said rollers enter in the direction perpendicular to the sheet discharging direction, and wherein the outer diameter portions of said rollers are contacted to the sheet so that the sheet waves with respect to the direction perpendicular to the sheet discharging direction.

9. A sheet discharging device according to claim 7, further comprising a detecting portion configured to detect the sheet discharged by said discharging portion, wherein said detecting portion includes a rotatable shaft provided along the direction perpendicular to the sheet discharging direction and a contact portion fixed on said shaft and contactable to a leading end of the sheet, and wherein said electrically discharging member includes a free end portion contacting the leading end of the sheet, the free end portion being disposed upstream of a position where the leading end of the sheet contacts said contact portion with respect to the discharging direction of the sheet.

10. A sheet discharging device according to claim 9, wherein said detecting portion includes a flag fixed on said shaft, said flag causing a photo-sensor to block light transmission or block light when said contact portion contacts the sheet stacked on said stacking portion and detecting a stacking upper limit of the sheet stacked on said stacking portion.

11. An image forming apparatus comprising a sheet discharging device according to claim 7.

12. A post processing device comprising a sheet discharging device according to claim 7.

* * * * *